United States Patent [19]

Tuckey

[11] Patent Number: 4,926,829

[45] Date of Patent: May 22, 1990

[54] PRESSURE-RESPONSIVE FUEL DELIVERY SYSTEM

[75] Inventor: Charles H. Tuckey, Cass City, Mich.

[73] Assignee: Walbro Corporation, Cass City, Mich.

[21] Appl. No.: 324,649

[22] Filed: Mar. 17, 1989

Related U.S. Application Data

[63] Continuation-in-part of Ser. No. 276,801, Nov. 28, 1988.

[51] Int. Cl.[5] ..... F02M 39/00

[52] U.S. Cl. ..... 123/497; 123/514; 123/41.31; 137/576

[58] Field of Search ..... 123/497, 514, 509, 510, 123/41.31, 499; 165/51; 137/574, 576

[56] References Cited

U.S. PATENT DOCUMENTS

| | | | |
|---|---|---|---|
| 3,699,931 | 10/1972 | Cinquegrani | 123/497 |
| 3,726,310 | 4/1973 | Coscia | 137/576 |
| 4,048,964 | 9/1977 | Rissel | 123/497 |
| 4,084,564 | 4/1978 | Rickert | 123/41.31 |
| 4,248,194 | 2/1981 | Drutchas | 123/497 |
| 4,260,333 | 4/1981 | Schillinger . | |
| 4,364,355 | 12/1982 | Karino | 123/41.31 |
| 4,397,333 | 8/1983 | Liba | 137/574 |
| 4,503,885 | 3/1985 | Hall | 123/516 |
| 4,756,291 | 7/1988 | Cummins | 123/497 |
| 4,800,859 | 1/1989 | Sagisaka | 123/497 |
| 4,811,709 | 3/1989 | Braun | 123/41.31 |

*Primary Examiner*—Carl Stuart Miller

*Attorney, Agent, or Firm*—Barnes, Kisselle, Raisch, Choate, Wittemore & Hulbert

[57] ABSTRACT

A fuel delivery system for internal combustion engines in which an electric-motor fuel pump supplies fuel under pressure from a tank to a fuel injector carried by the engine, and excess fuel is returned by a pressure regulator from the engine to the supply tank. A restriction is positioned in the fuel return line to restrict flow of return fuel therethrough, and thereby create a back-pressure of fuel in the return line. A pressure sensor is coupled to the return line between the pressure regulator and the restriction and drives the fuel pump as an inverse function of fuel pressure in the return line, and thus as a direct function of fuel demand at the engine.

9 Claims, 1 Drawing Sheet

PRESSURE-RESPONSIVE FUEL DELIVERY SYSTEM

This application is a continuation-in-part of application Ser. No. 276,801 filed Nov. 28, 1988 still pending.

The present invention is directed to fuel delivery systems for internal combustion engines, and more particularly to a system for controlling fuel delivery as a function of fuel requirements.

BACKGROUND AND OBJECTS OF THE INVENTION

In engine fuel delivery systems of current design, fuel is fed by a constant-delivery pump from a fuel tank to the engine, and excess fuel is returned from the engine to the fuel tank. Such return fuel carries engine heat to the fuel supply tank, and consequently increases temperature and vapor pressure at the fuel tank. Venting of excess vapor pressure to the atmosphere not only causes pollution problems, but also deleteriously affects fuel mileage. Excess fuel tank temperature can also cause vapor lock at the pump, particularly where fuel level is relatively low. Constant pump operation also increases energy consumption while decreasing both pump life and fuel filter life.

U.S. Pat. No. 4,649,884 discloses a fuel injection system for an internal combustion engine in which an electric-motor constant-delivery fuel pump supplies fuel under pressure from a tank to a fuel rail positioned on the engine. Excess fuel is returned to the supply tank through a pressure regulator as a function of pressure differential between the fuel rail and the engine air intake manifold. A plurality of fuel injectors are mounted between the fuel rail and the engine air manifold, with the injector nozzles being positioned adjacent to the fuel/air intake ports of the individual engine cylinders. U.S. Pat. No. 4,789,308, discloses a fuel delivery system for an internal combustion engine in which outlet pressure of an electric-motor fuel pump is monitored, and pump motor current is controlled as a function of such outlet pressure. Although the fuel delivery systems disclosed in the noted patents address the aforementioned problems in current fuel delivery system designs, further improvements remain desirable.

Parent application Ser. No. 276,801, filed Nov. 28, 1988 and assigned to the assignee hereof, discloses a fuel delivery system for an internal combustion engine that includes a fuel supply having an electric-motor fuel pump responsive to application of electrical power for delivering fuel under pressure. An engine air intake manifold supplies combustion air to the various engine cylinders, and at least one fuel injector is connected between the fuel supply and the air manifold. Pressure sensor mechanisms, preferably in the form of an integral differential pressure sensor, are responsive to pressure at the fuel injector and at the engine air manifold for supplying an electrical signal that varies as a function of pressure differential therebetween. The electric-motor fuel pump is driven as a function of such pressure differential, preferably by an analog or digital pulse width modulation amplifier that applies pulsed d.c. power to the motor at constant frequency and at a duty cycle that varies as a function of the pressure differential signal. In this way, fuel pressure at the injector is automatically controlled so as to maintain a constant pressure differential across the injeotor between the fuel rail and the engine air intake manifold, reduce volume of circulating fuel and thus engine heat delivered to the fuel tank, and energize the fuel delivery pump as a function of fuel demand. A problem with the system described in the parent application lies in the fact that the pump control electronics is directly responsive to pressure at the injector, which can fluctuate significantly during normal operation. That is, fuel pressure at the injector is controlled directly by the pump. As a result, the control system is overly sensitive, with motor speed continuously being cycled and adjusted.

An object of the present invention is to provide a fuel delivery system that maintains constant pressure differential across the fuel delivery mechanism, such as a fuel injector, so that the quantity of fuel supplied for a given injector activation time remains substantially constant and independent of fluctuations in air intake manifold pressure. Another object of the invention is to provide a fuel delivery system of the described character that is economical to implement in mass production of automotive fuel delivery systems, for example, and is reliable over an extended vehicle lifetime. A further object of the present invention is to provide a fuel delivery system of the described character that achieves on-demand fuel delivery, and thus reduces energy consumption while increasing pump and fuel filter operating lifetimes. Yet another object of the invention is to provide a fuel delivery system of the described character that reduces delivery of engine heat to the fuel tank, and thus reduces problems associated with fuel vaporization as hereinabove discussed. A further object of the invention is to provide a fuel delivery system that implements electronic control of the fuel pump as a function of fuel requirements, and in which the control electronics is cooled by fuel circulating in the delivery system.

SUMMARY OF THE INVENTION

In accordance with the present invention, the foregoing and other objectives are obtained by providing a fuel delivery system for an internal combustion engine that includes a fuel supply having an electric-motor fuel pump responsive to application of electrical power for delivering fuel under pressure. A fuel delivery mechanism such as a fuel injector is coupled to the fuel supply for controlled delivery of fuel from the supply to an engine manifold. A pressure regulator feeds excess fuel from the fuel injector through a return line to the supply. In accordance with the invention, facility is provided for detecting flow of fuel through the return line, thereby indicating excess fuel at the injector. Fuel pump speed is reduced accordingly as an inverse function of such return fuel flow.

The flow detector in the fuel return line preferably comprises a restriction in the fuel return line for restricting flow of fuel therethrough and thereby developing a back-pressure of fuel in the return line. A pressure sensor is coupled to the return line and is responsive to a difference between fuel back-pressure and atmospheric pressure for supplying an electrical pressure signal, and the fuel pump is driven as a function of such signal. In this way, fuel pressure at the injector is automatically controlled so as to maintain a constant pressure differential across the injector, reduce volume of circulating fuel and thus heat energy delivery to the fuel tank, and to energize the fuel pump as a function of fuel demand. A valve is responsive to excess pressure in the fuel return line for dumping fuel directly to the supply tank.

In a preferred embodiment of the present invention, the fuel supply takes the form of a reservoir or canister positioned within a fuel tank, with the pump being positioned within the canister for delivering fuel from the canister to the injector. A jet pump includes a conduit connecting the canister to the surrounding tank, with the return fuel restriction taking the form of an orifice constructed and arranged with respect to the conduit such that return fuel flowing through the orifice aspirates fuel through the conduit from the surrounding tank into the canister. The pump control electronics, which may be either digital or analog in nature, is mounted on a printed circuitboard. The circuitboard is mounted on a body of heat conductive material having a passage through which circulating fuel is fed, so that the circulating fuel draws heat from and effectively cools the pump drive electronics.

BRIEF DESCRIPTION OF THE DRAWINGS

The invention, together with additional objects, features and advantages thereof, will be best understood from the following description, the appended claims and the accompanying drawing in which:

DETAILED DESCRIPTION OF PREFERRED EMBODIMENTS

The disclosure of parent application Ser. No. 276,801, filed Nov. 28, 1988 and assigned to the assignee hereof, is incorporated herein by reference.

Figure 1:
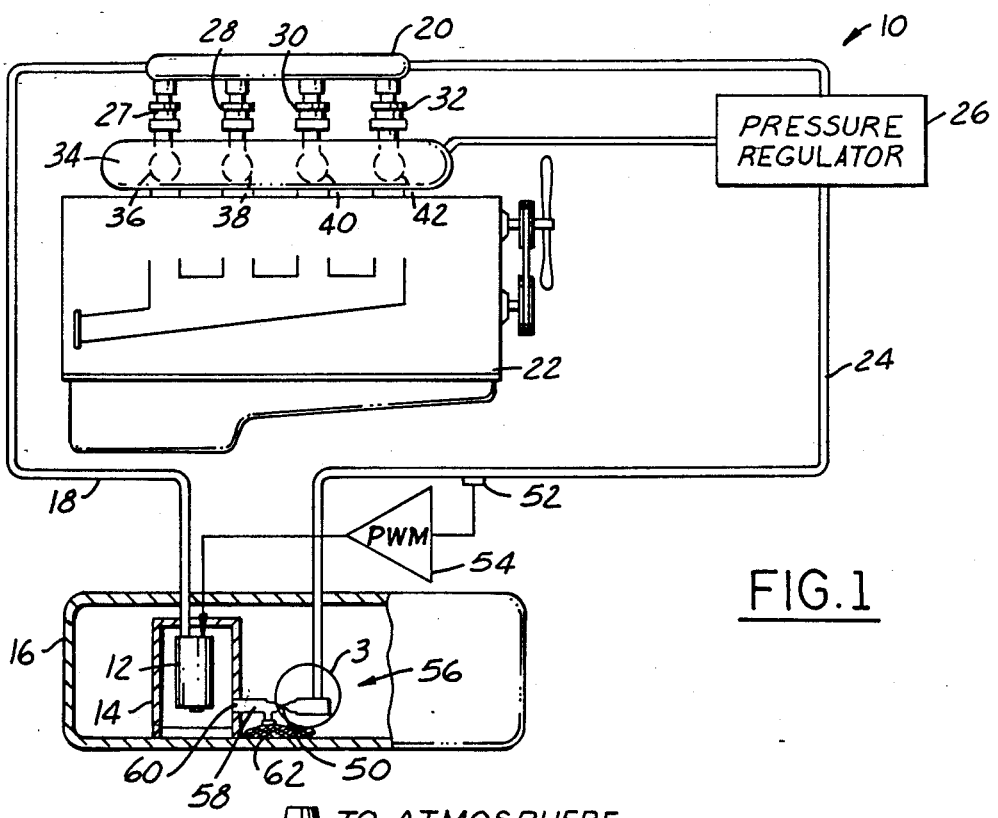
FIG. 1 is a schematic diagram of a fuel delivery system in accordance with one presently preferred embodiment of the invention.

FIG. 1 illustrates a fuel delivery system 10 in accordance with one presently preferred embodiment of the invention as comprising an electric-motor fuel pump 12 mounted within a canister 14 that is contained within and surrounded by a fuel tank 16. Fuel pump 12 delivers fuel under pressure through a fuel line 18 to a fuel rail 20 carried on an engine 22. Excess fuel at rail 20 is returned to tank 16 through a fuel return line 24 that contains a pressure regulator 26. A plurality of fuel injectors 27–32 are mounted between rail 20 and an engine air intake manifold 34 carried by engine 22, with the nozzles of the individual fuel injectors 27–32 being positioned adjacent to the fuel/air intake ports 36–42 of associated cylinders of the engine. The reference input or vent of pressure regulator 26 is connected to air intake manifold 34, so that any fuel flow through regulator 26 and return line 24 effectively indicates excess fuel at rail 20 over that needed to maintain constant pressure differential across injectors 27–32.

To the extent thus far described, fuel delivery system 10 is disclosed in U.S. Pat. No. 4,649,884 noted above. A suitable fuel pressure regulator 26 is disclosed in U.S. Pat. No. 4,646,700. Combustion air may be supplied to manifold 34 through an air filter or the like at atmospheric pressure, or by a turbocharger or the like driven by the engine and supplying air at pressure that varies with engine operation and/or throttle demand, etc. Injectors 27–32 may be solenoid-activated, for example, by an on-board engine control computer (not shown). In accordance with the present invention, apparatus is provided in return line 24 for measuring flow of fuel through line 24 —i.e., excess fuel over that needed at rail 20—and providing corresponding electrical control signals for decreasing pump speed as a function thereof.

More specifically, a restriction 50 is positioned in fuel return line 24 downstream of pressure regulator 26 for restricting flow of fuel through the return line, and thereby creating a back-pressure of fuel in the return line that varies as an inverse function of fuel demand at the injectors. A pressure sensor 52 is coupled to return line 24 between restriction 50 and regulator 26, and provides an electrical output signal as a function of a difference between fuel pressure in return line 24 and surrounding atmospheric pressure. Pressure sensor 52 is connected to a pulse width modulation amplifier 54. Amplifier 54 also receives d.c. electrical power from the vehicle electrical system, and provides a pulse width modulated output signal to energize the electric motor of pump 12. The pulse width modulated output of amplifier 54 is preferably supplied at constant frequency, and at a duty cycle that varies as a function of, preferably an inverse linear function of, the output of pressure sensor 52. When pressure in fuel return line 24 is low, such as during periods of accelerated engine operation when fuel demand is high, the duty cycle of the amplifier output is high. Thus, average d.c. power applied to pump 12 is high and the pump is energized accordingly. On the other hand, when the fuel back-pressure in return line 24 is high, such as when the engine is idling and therefore has lower fuel demand, the duty cycle of the amplifier output is correspondingly low, and the fuel pump is energized at a lower level.

Figure 3:
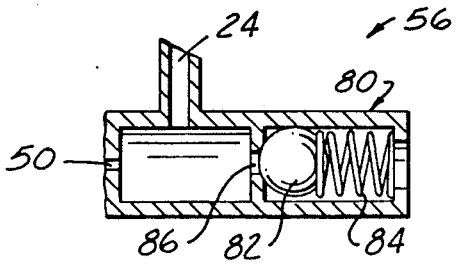
FIG. 3 is a sectional view on an enlarged scale of that portion of FIG. 1 within the circle 3.

In the preferred embodiment of the invention illustrated in FIGS. 1 and 3, restriction 50 takes the form of a nozzle orifice in jet pump 56 that includes a right-angle conduit 58 connecting the inlet port 60 of canister 14 with the surrounding tank 16. Thus, high-pressure flow of return fuel through orifice 50 aspirates or draws fuel from the surrounding tank 16 through filter sock 62, and thereby delivers aspirated and return fuel through port 60 to canister 14. It will thus be appreciated that return fuel is delivered to canister 14 in preference to delivery to the surrounding tank 16, which helps reduce transfer of heat energy from the return fuel to the fuel within tank 16, and thereby helps reduce generation of fuel vapors in the tank. A relief valve 80 (FIG. 3) includes a ball 82 urged by a spring 84 to close a port 86 opposed to orifice 50. As pressure of fuel in return line 24 increases against the force of spring 84, fuel is dumped directly into tank 16. Thus, valve 80 prevents excessive pressure increase in the return line, as in the event that the electronic fuel control fails and renders pump 12 full on under all operating conditions. Cracking pressure of valve 80 should be set above the operating pressure range of the control system.

Figure 2:
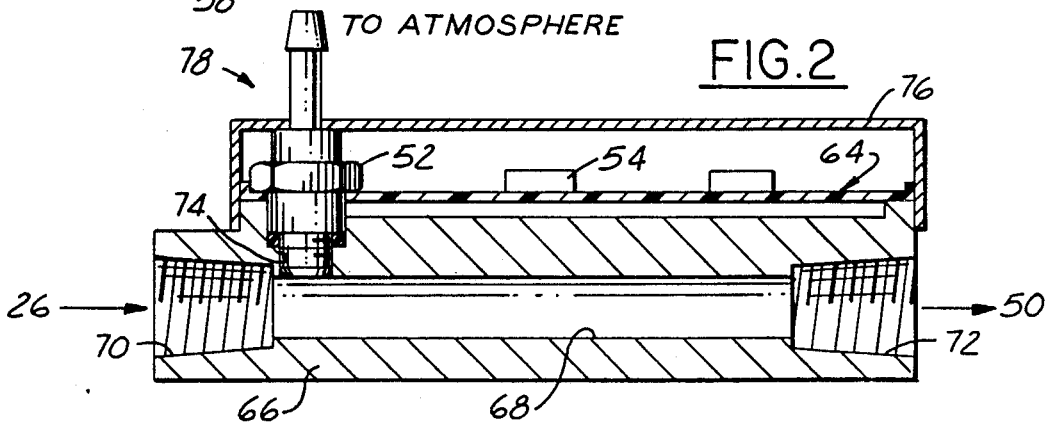
FIG. 2 is a sectioned elevational view of an enclosure for mounting the pump control electronics in the embodiment of FIG. 1.

FIG. 2 illustrates the pump control electronics, including pressure sensor 52 and amplifier 54, mounted as a printed circuitboard assembly 64 on a body 66 of heat conductive material construction, such as stainless steel. Body 66 has a passage 68 that extends therethrough, having an inlet opening 70 for connection by suitable hoses to regulator 26, and an outlet opening 72 for connection by suitable hoses to orifice 50 of jet pump 56 (FIG. 1). Thus, body 66 is connected in fuel return line 24 so that fuel circulating through line 24 draws heat from and effectively cools the pump control electronics. Pressure sensor 52 has one pressure input connected by a lateral passage 74 in body 66 to communicate with the main fuel passage 56, and a second pressure input open to atmosphere. Assembly 64, including sensor 52, is enclosed by a cover 76 to form an integral package 78. It will be appreciated that amplifier 54 may be of either analog or digital construction, including microprocessor-based digital construction.

There have thus been disclosed several embodiments of a fuel delivery system that fully satisfy all of the objects and aims previously set forth. The fuel pump is energized on demand, as distinguished from constant-delivery fuel pumps characteristic of the prior art, thus reducing energy consumption and increasing both pump life and the operating life of fuel filter 62. Because the fuel pump is energized only on demand, volume of circulating fuel returned to the fuel tank is greatly reduced, thus decreasing delivery of heat to the fuel tank. Consequently, problems associated with fuel vaporization are likewise reduced. Although the invention has been described in conjunction with presently preferred embodiments thereof illustrated in the drawings, it will be appreciated that many alternatives and modifications may be implemented without departing from the general principles of the invention. For example, other types of electrically-powered fuel pumps may be employed, such as a mechanical fuel pump whose output is modulated by an electronic solenoid valve. Likewise, although pulse width modulation of the pump drive voltage is presently preferred, frequency modulation or d.c. current or voltage control could also be employed. Fuel pump 12 need not be contained within a canister 14 in accordance with the invention in its broadest aspects, although such construction is presently preferred for reasons previously set forth.

I claim:

1. A fuel delivery system for an internal combustion engine that includes a fuel supply with a pump responsive to application of electrical power for delivering fuel under pressure, an engine air intake manifold, fuel delivery means coupled to said fuel supply for controlled delivery of fuel from said supply to said manifold, pressure regulator means having a first input responsive to fuel pressure at said fuel delivery means, a reference input connected to said air intake manifold and an outlet connected through a fuel return to said supply, said regulator means being responsive to a predetermined pressure differentials across said fuel delivery means for passing excess fuel through said return to said supply, and means for applying electrical power to said pump; characterized in that said power-applying means comprises:

means in said return between said regulating means and said supply for restricting flow of fuel therethrough and thereby developing a back pressure of fuel in said return between said restricting means and said regulator means, a differential pressure sensor having a first input coupled to said return between said restricting means and said regulator means, a second input connected to receive air at ambient pressure and an output for supplying an electrical sensor signal as a direct continuous function of a differential between said back pressure and ambient caused by fuel flow through said return, and means for applying electrical power to said pump as a continuous inverse function of said sensor signal.

2. The system set forth in claim 1 wherein said power-applying means comprises a pulse width modulation amplifier responsive to said signal for applying modulated d.c. power to said pump at constant frequency and at a duty cycle that varies as a function of said signal.

3. The system set forth in claim 1 further comprising a body of heat conductive construction having a fuel passage extending therethrough connected in said fuel-returning means, said power-applying means being mounted on said body such that fuel passing through said body cools said power-applying means.

4. The system set forth in claim 3 wherein said power-applying means, including said sensor and said signal-responsive means, comprises a printed circuitboard assembly mounted on said body.

5. The system set forth in claim 4 wherein said power-applying means further includes means for applying pulse width modulated d.c. power to said pump at constant frequency and at a duty cycle that varies as a function of said pressure signal.

6. The system set forth in claim 4 further comprising valve means responsive to fuel back-pressure in said fuel returning means for dumping fuel to said supply bypassing said restricting means.

7. The system set forth in claim 4 wherein said fuel supply comprises a fuel tank, a canister carried within said tank, said pump being positioned in said canister for delivering fuel from said canister to said fuel delivery means, and means for feeding fuel into said canister from the surrounding tank; characterized in that said fuel-feeding means comprises:

a jet pump including conduit means connecting said canister to said tank, and a nozzle orifice formed by said restricting means constructed and arranged with respect to said conduit means such that return fuel flowing through said orifice aspirates fuel through said conduit means from said tank into said canister.

8. The system set forth in claim 1 wherein said fuel supply comprises a fuel tank, a canister carried within said tank, said pump being positioned in said canister for delivering fuel from said canister to said fuel delivery means, and means for feeding fuel into said canister from the surrounding tank; characterized in that said fuel-feeding means comprises:

a jet pump including conduit means connecting said canister to said tank, and a nozzle orifice formed by said restricting means constructed and arranged with respect to said conduit means such that return fuel flowing through said orifice aspirates fuel through said conduit means from said tank into said canister.

9. The system set forth in claim 8 further comprising valve means responsive to fuel back-pressure in said fuel returning means for dumping fuel to said supply bypassing said restricting means.

* * * * *